US006988752B2

(12) United States Patent
Belchine, III et al.

(10) Patent No.: US 6,988,752 B2
(45) Date of Patent: Jan. 24, 2006

(54) PINLESS INSIDE DOOR HANDLE ASSEMBLY

(75) Inventors: Walter Belchine, III, Plainfield, IL (US); Sven E. Carlson, Manhattan, IL (US); Joel R. Lee, Homewood, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/739,884

(22) Filed: Dec. 18, 2003

(65) Prior Publication Data

US 2005/0134058 A1 Jun. 23, 2005

(51) Int. Cl.
*E05B 3/00* (2006.01)

(52) U.S. Cl. ..... 292/336.3; 292/347; 292/DIG. 23; 292/DIG. 53; 292/DIG. 64; 16/266

(58) Field of Classification Search ..... 292/336.3, 292/347, DIG. 23, DIG. 53, DIG. 64; 16/266

See application file for complete search history.

(56) References Cited

U.S. PATENT DOCUMENTS

| | | | | | |
|---|---|---|---|---|---|
| 4,580,822 | A | * | 4/1986 | Fukumoto | 292/336.3 |
| 4,858,973 | A | * | 8/1989 | Ogasawara et al. | 292/347 |
| 5,129,694 | A | * | 7/1992 | Tanimoto et al. | 292/347 |
| 5,263,750 | A | * | 11/1993 | Smith et al. | 292/336.3 |
| 5,651,163 | A | * | 7/1997 | Tamaki | 292/336.3 |
| 5,794,994 | A | * | 8/1998 | Miyagawa et al. | 292/336.3 |
| 5,895,081 | A | | 4/1999 | Tanimoto et al. | 292/348 |
| 6,152,501 | A | * | 11/2000 | Magi et al. | 292/336.3 |
| 6,167,779 | B1 | * | 1/2001 | Sano et al. | 74/543 |

FOREIGN PATENT DOCUMENTS

| | | | |
|---|---|---|---|
| DE | 2824216 | * | 6/1979 |
| DE | 196 16 221 A1 | | 10/1996 |

* cited by examiner

*Primary Examiner*—Brian E. Glessner
*Assistant Examiner*—Carlos Lugo
(74) *Attorney, Agent, or Firm*—Mark W. Croll; Paul F. Donovan

(57) ABSTRACT

A pinless inside door handle assembly has a housing, a latch handle and a lock lever that snap together and require no separate pivot pin. Interrelating projections and enclosed apertures are in pivotal engagement.

17 Claims, 3 Drawing Sheets

PINLESS INSIDE DOOR HANDLE ASSEMBLY

FIELD OF THE INVENTION

The present invention relates generally to automobile door handle assemblies, and, more particularly, the invention relates to a compact door handle assembly in which a door latch release handle and lock lever are contained in a single housing.

BACKGROUND OF THE INVENTION

Vehicle door handle assemblies are known to include a door latch release handle connected by a cable to the door latch mechanism that is triggered to release the door by operation of the handle. Vehicle doors also are known to include a lock mechanism to secure the door in a closed. Manually operated lock mechanisms include an activator lever or button for engaging and disengaging the lock mechanism.

Manually activated door handle mechanisms have taken a variety of different constructions. For safety reasons, smooth designs are preferred, without projecting components. Safety and functionality have driven designs toward smooth, sleek appearances in which both the latch handle and lock lever are inset in the door panel, often contained in a single housing or located adjacent each other in a portion of the door. Cables from each the latch handle and the lock lever interconnect the handle and lever to the respective mechanisms for releasing the door and for locking and unlocking the door. Moving the latch handle actuates the latch mechanism to unlatch the door. The latch handle returns to the non-actuating position when it is released. Lock mechanisms are known to operate with a lock lever that toggles between locked and unlocked positions.

It is known to use a pin or pins through the latch handle and lock lever to secure the handle and lever in the housing. The handle and lever each can be rotated about the pin during operation and use of the mechanisms. The pin or pins are inserted through apertures in the housing and handles and must be secured therein. The use of a fastener or retainer such as a compression cap on the pin ends effectively retains the pin in position but renders the assembly of the mechanism both complicated and time consuming.

U.S. Pat. No. 5,895,081 entitled "Inside Door Handle Assembly For Vehicles" proposes an assembly in which housing walls include projections and the latch handle and lock knob include through holes received on the projections. A wall of the knob defining one of the through holes is provided with a cutout portion so that a part of the wall around the hole is deformable. The cutout has a width less than the width of the projection received therein. Utilizing a cutout entrance into the aperture is not preferred in that the material is necessarily thin to allow adequate deflection, which can lead to fractures and failure. Deflection is localized in a small area, leading to possible material fatigue and failure. Further, the potential exists for the knob to become misaligned such that the projection partly re-enters the slot, potentially causing malfunction of the knob. Therefore, smooth, continuous apertures surrounding the projections are preferred.

It is desirable to provide a pin-less inside door handle assembly that is easy to assembly and secure in final assembly.

SUMMARY OF THE INVENTION

The present invention provides a snap-together assembly having no separate pivot pin, but instead interrelating projections and enclosed apertures in pivotal engagement.

In one aspect thereof, the present invention provides a door handle assembly with a housing including a first outer wall defining a first aperture, a second outer wall defining a second aperture, and a partition wall between the outer walls. The partition wall has a projection extending toward the second outer wall. A latch handle has a handle projection received in one of the apertures of the first and second outer walls. The latch handle defines a latch handle aperture receiving the partitioned wall projection therein. A lock lever has a lock a lever projection received in the other of the apertures in the outer walls, and the lock lever defines a lock lever aperture receiving the projection of the partition wall. One of the latch handle and the lock lever spans the partition wall.

In another aspect thereof, the present invention provides a vehicle door handle assembly with a housing having first and second outer walls and a partition wall. The housing has a first chamber defined between the first outer wall and the partition wall, and a second chamber between the second outer wall and the partition wall. The first outer wall has a first outer wall aperture, and the second outer wall has a second outer wall aperture. The partition wall has a projection extending into the second chamber. A latch handle is received substantially in the first chamber, and has an extension spanning the partition wall and a panel from the extension extending into the second chamber. The latch handle has a latch handle projection received in the first outer wall aperture and a latch handle aperture in the panel receiving the partition wall projection. A lock lever is received in the second chamber, and is disposed between the latch handle partition and the second outer wall. The lock lever has a lock lever aperture for receiving the partition wall projection and a lock lever projection received in the second outer wall aperture.

In still another aspect thereof, the present invention provides a method for assembling a vehicle door handle assembly. A housing is provided with first and second outer walls defining first and second apertures, and a partition wall therebetween. A projection is provided on the partition wall directed toward the second outer wall. A latch handle is provided having an aperture therein and a projection therefrom. Assembly further includes aligning axially the projection of the latch handle with the aperture of the first outer wall and the aperture of the latch handle with the projection of the partition wall; causing relative lateral movement between the latch handle and the housing and causing the latch handle projection to be received in the first outer wall aperture and the partition wall projection in the latch handle aperture; providing a lock lever having a lock lever aperture and a lock lever projection. Assembly further includes aligning the lock lever aperture with the partition wall projection substantially parallel thereto but outwardly therefrom, and the lock lever projection with the second outer wall aperture substantially parallel thereto but outwardly therefrom; urging the lock lever between the partition wall and the second outer wall while deflecting the partition wall and the outer wall outwardly relative to each other; and engaging the lock lever projection in the second outer wall aperture and the lock lever aperture around the partition wall projection outwardly on the partition wall projection from the latch handle aperture.

An advantage of the present invention is providing an inside door handle assembly that is compact.

Another advantage of the present invention is providing an inside door handle assembly for vehicles, which is stable in operation, yet easy to assembly.

Still another advantage of the present invention is providing an inside door handle assembly with few independent parts, consisting of only a few monolithic structures.

Other features and advantages of the invention will become apparent to those skilled in the art upon review of the following detailed description, claims and drawings in which like numerals are used to designate like features.

Figure 1:
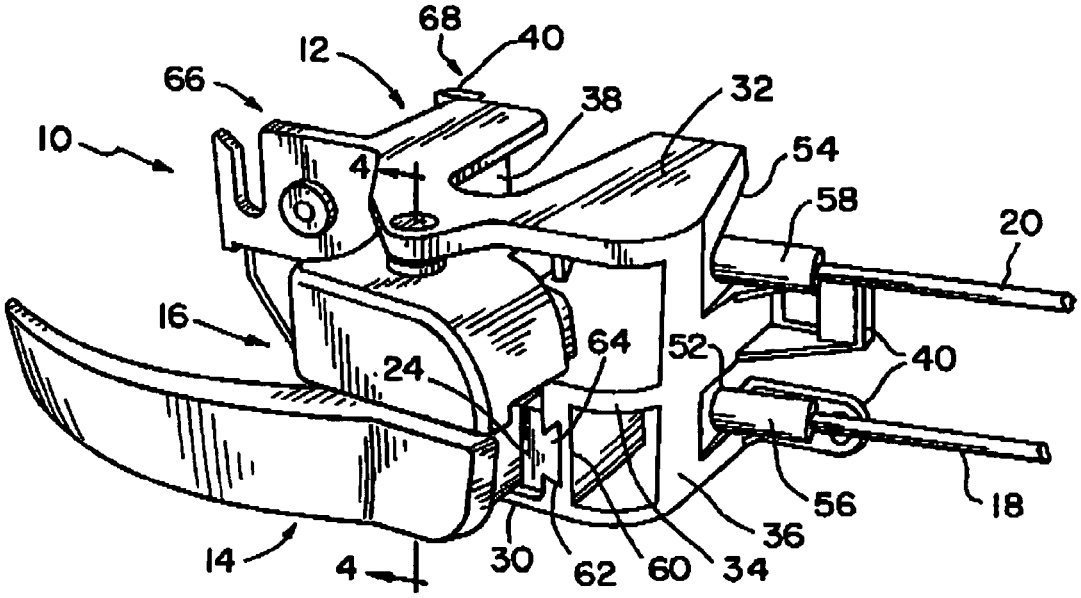
FIG. 1 is a perspective view of a pin-less inside door handle assembly in accordance with the present invention.
Figure 4:
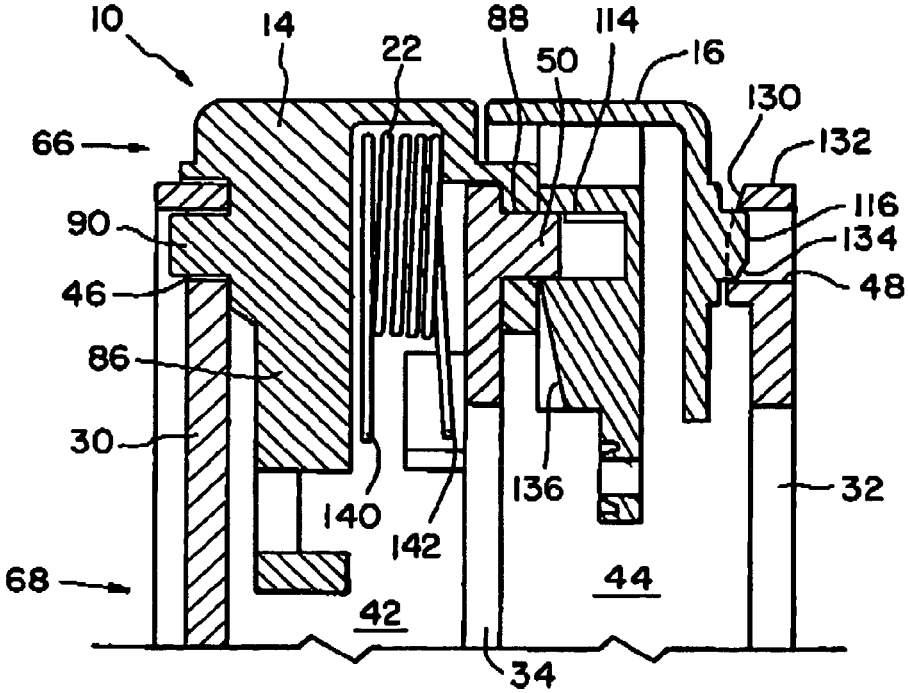
FIG. 4 is a cross-sectional view of the pin-less inside door handle assembly, taken along line 4—4 of FIG. 1.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use herein of "including", "comprising" and variations thereof is meant to encompass the items listed thereafter and equivalents thereof, as well as additional items and equivalents thereof.

DETAILED DESCRIPTION OF THE PREFERRED EMBODIMENT

Figure 2:
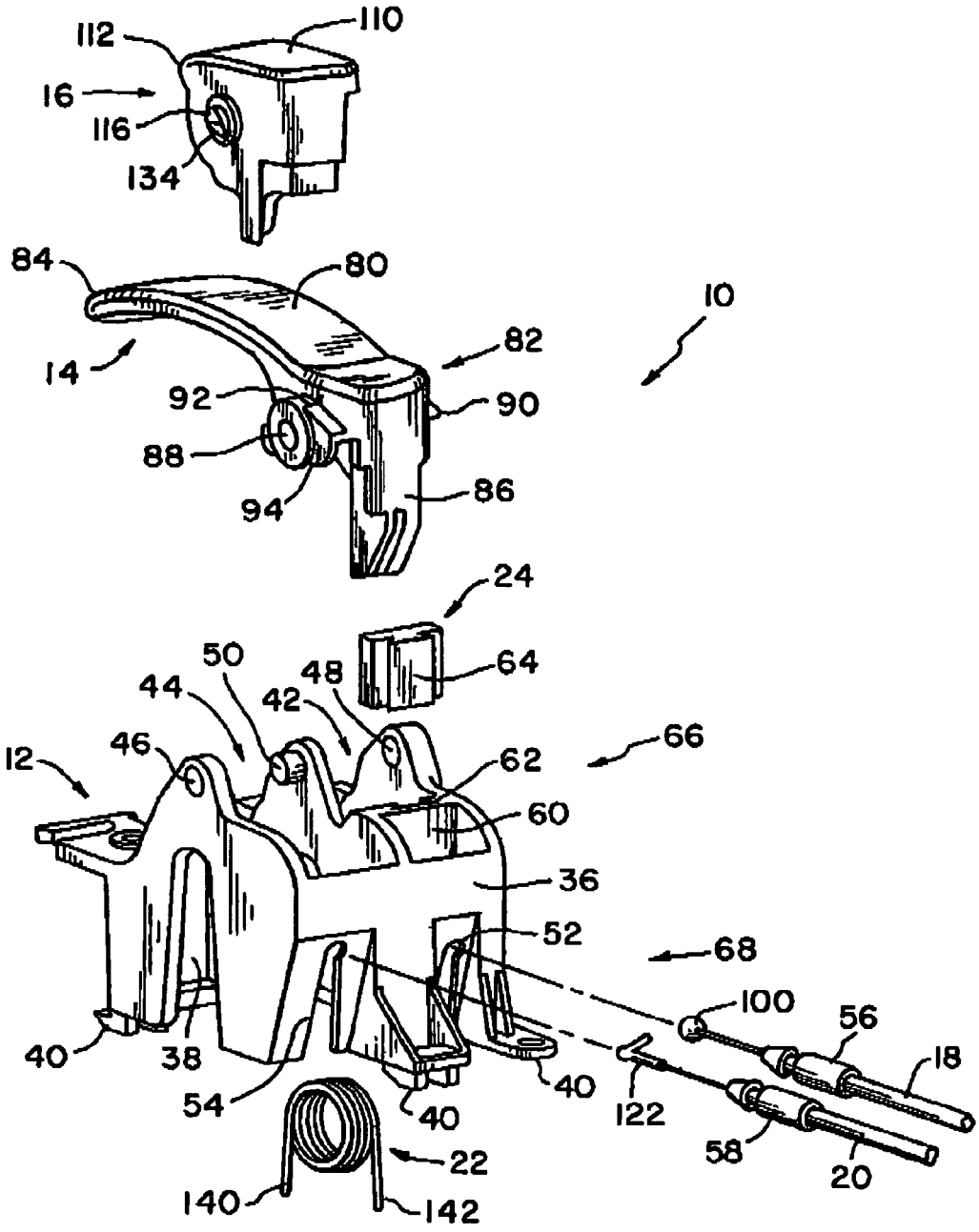
FIG. 2 is an exploded perspective view of the door handle assembly shown in FIG. 1.
Figure 3:
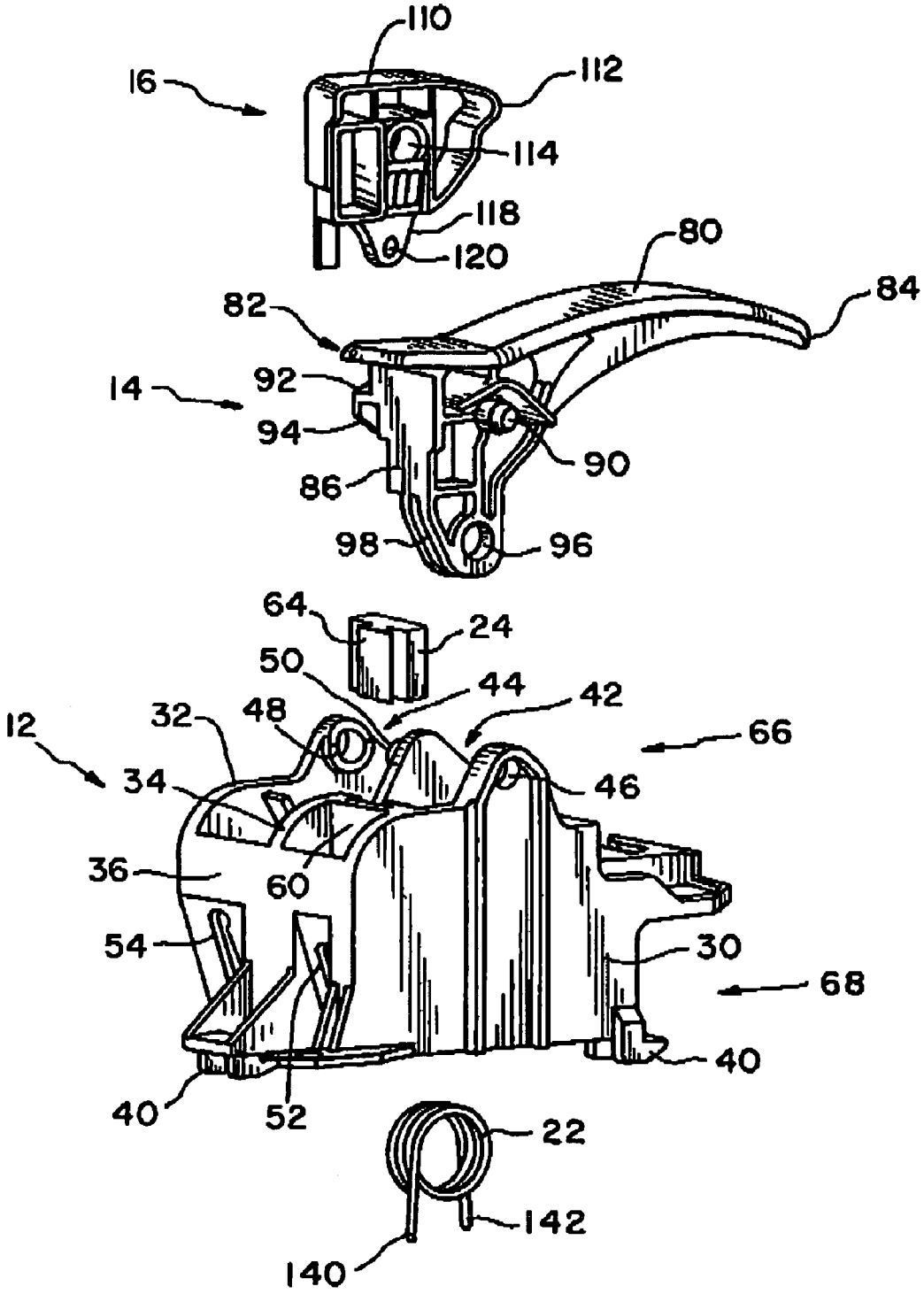
FIG. 3 is a an exploded perspective view of the door handle assembly shown in FIGS. 1 and 2, but shown from a different side than shown in FIG. 2.

Referring now more specifically to the drawings and to FIG. 1 in particular, a door handle assembly 10 in accordance with the present invention is shown. Door handle assembly 10 includes a housing 12 adapted for installation and attachment in a vehicle door panel, armrest or the like. A latch handle 14 and lock lever 16 are operatively disposed in housing 12. A latch cable 18 is connected to latch handle 14 at one end, and at the opposite end to a latch/release mechanism (not shown) of the vehicle door. A lock cable 20 is connected at one end to lock lever 16 and at an opposite end to a lock mechanism (not shown) of the vehicle door. As shown in FIG. 2, door handle assembly 10 further includes a biasing spring 22 and a resilient bumper 24 operatively associated with latch handle 14 in housing 12.

The specific configuration of housing 12, latch handle 14 and lock lever 16 vary for installation in a variety of different vehicle doors. Thus, the specific shape, size and the like of each shown in the drawings is for purposes of illustration and should not be considered as limiting on the scope of the present invention.

Housing 12 is a monolithic structure of plastic or the like, and includes a first outer wall 30 a second outer wall 32 and a partition wall 34 disposed between first and second outer walls 30 and 32. End panels 36 and 38 interconnect first and second outer walls 30, 32 and partition wall 34. Various mounting structures 40 are provided, by which housing 12 is secured in a vehicle door panel, armrest or the like.

First and second outer walls 30, 32 and partition wall 34 are spaced from each other to define first and second chambers 42 and 44, respectively. First outer wall 30 defines a first outer wall aperture 46. Second outer wall 32 defines a second outer wall aperture 48. Apertures 46 and 48 have openings thereto in first and second chambers 42 and 44, respectively. Partition wall 34 defines a boss or projection 50 extending therefrom into second chamber 44, generally directed toward second outer wall 32. In an advantageous configuration of the present invention, first outer wall aperture 46, second outer wall aperture 48 and partition wall projection 50 are arranged in housing 12 in substantially axial alignment.

End panel 36 defines first and second cable slots 52 and 54 for receiving and holding latch cable 18 and lock cable 20, respectively. Grommet-like fittings 56 and 58 are providing on cables 18 and 20, respectively, by which cables 18 and 20 are secured in cable slots 52 and 54.

First chamber 42 includes a cross member 60 defining a channel 62 therein for receiving a shaped anchor portion 64 of bumper 24.

Housing 12 has an exposed or outer end 66 disposed generally at the surface of the door panel or armrest in which it is installed for use, and a non exposed or inner end 68 generally within the door panel, armrest or the like. For ease and clarity of description herein, reference will be made to the outer and/or inner ends, sides or directions of various components. Such descriptions should be understood to mean the portion, surface, direction, etc. that is more closely positioned to outer end 66 or inner end 68, and not necessarily positioned at the extreme outer or inner end.

Latch handle 14 and lock lever 16 are disposed in first and second chambers 42 and 44, respectively, generally at outer end 66 and extending toward inner end 68. Cables 18 and 20 connect to latch handle 14 and lock lever 16 within chambers 42 and 44, respectively. Channel 62 of cross member 60 is open at the outer end and closed at the inner end (not shown) thereof. Anchor portion 64 of bumper 24 can be inserted into channel 62 from the outer end thereof, and secured therein by resting against the closed inner end of channel 62.

First outer wall aperture wall 46, second outer wall aperture 48 and partition wall projection 50 are in substantially axial alignment near outer end 66 of housing 12. Latch handle 14 and lock lever 14 are configured for attachment to housing 12 via first outer wall aperture 46, second outer wall 48 and partition wall projection 50, as will be described more fully herein after. Latch handle 14 and lock lever 16 are rotatable through at least limited arcs within housing 12.

Latch handle 14 is a substantially monolithic structure of molded plastic or the like, and includes a hand grasp 80 having an anchor end 82 and a distal end 84. An inner arm 86 of latch handle 14 is integral with hand grasp 80 and forms a generally right angle with hand grasp 80 such that arm 86 extends into first chamber 42 with hand grasp 80 extending substantially along outer end 66 of first chamber 42. At anchor end 82, latch handle 14 defines a latch handle aperture 88 configured to slide over partition wall projection 50. Latch handle 14 further defines a latch handle projection 90 directed outwardly therefrom, and configured to be received in first outer wall aperture 46. Since partition wall projection 50 is directed toward second outer wall 32 and extends into second chamber 44, latch handle 14 includes an extension 92 that spans partition wall 34, and a inwardly depending panel 94 that extends into second chamber 44. Latch handle aperture 88 is provided in panel 94.

At a lower end thereof, inner arm 86 defines a hole 96 and a slot 98 for receiving and securing latch cable 18, and specifically a ball 100 at one end of latch cable 18.

Lock lever 16 is a substantially monolithic structure of molded plastic or the like, configured to be received in second chamber 44. Lock lever 16 includes an outer face 110 having a slight tail 112 to facilitate lift. Lock lever 16 is a substantially block-like body, not necessarily solid or smooth, and defines a lock lever aperture 114 on one side thereof and a lock lever projection 116 on the opposite side thereof. Lock lever 16 includes a connector portion 118 extending into second chamber 44. Lock lever aperture 114 and lock lever 116 are somewhat centrally located at the sides of lock lever 16 such that, when connected in housing 12, lock lever 16 can be toggled between first and second positions for locking and unlocking the door. Lock lever aperture 114 is configured for receiving partition wall projection 50 therein, and lock lever projection 116 is configured for being received in second outer wall aperture 48. Connector portion 118 defines a hole 120 for receiving a substantially right angle anchor 122 at one end of lock cable 20.

During assembly, bumper 24 is attached to cross member 60 of housing 12 by sliding anchor portion 64 into channel 62. Inner arm 86 of latch handle 14 is inserted into first chamber 42 of housing 12, with latch handle 14 being offset toward partition wall 34. Extension 92 spans partition wall 34 such that panel 94 depends from extension 92 into second chamber 44. Latch handle aperture 88 is aligned axially with partition wall projection 50, and latch handle projection 90 is aligned axially with first outer wall aperture 46. Relative lateral movement is created between housing 12 and latch handle 14 such that latch handle projection 90 is inserted into first outer wall aperture 46, and partition wall projection 50 is inserted into latch handle aperture 88.

Lock lever 16 is moved into position at outer end 66 of housing 12, with lock lever aperture 114 positioned substantially parallel to and outwardly of partition wall projection 50, and lock lever projection 116 positioned substantially parallel to and outwardly of second outer wall aperture 48. Lock lever 16 is urged into chamber 44 such that second outer wall 32 and partition wall 34 are displaced slightly away from each other, allowing lock lever 16 to be inserted. During insertion, lock lever aperture 114 and lock lever projection 116 become axially aligned with partition wall projection 50 and second outer wall aperture 48, respectively. Partition wall 34 and second outer wall 32 spring back to non-deflected positions such that partition wall projection 50 is received in lock lever aperture 114 and lock lever projection 116 is received in second outer wall aperture 48. Panel 94 is thereby disposed on partition wall projection 50 between partition wall 34 and lock lever 16, and the entire assembly of housing 12, latch handle 14 and lock lever 16 is thereby secured.

To promote relative deflection between partition wall 34 and second outer wall 32 during a fluid operation to insert lock lever 16 into second chamber 34, second outer wall 32 is provided with an inwardly angled, ramp-like surface 130 extending from an outer edge 132 of second outer wall 32 to an outer portion of second outer wall aperture 48. An inner portion 134 of latch handle projection 90 is angled relative to the insertion direction of lock lever 16, for sliding along ramp-like surface 130. Connector portion 118 extending into second chamber 44 is provided with an elongated ramp-like surface 136 leading to latch handle aperture 88. Thus, lock lever 16 can be inserted partly into second chamber 44 without relative deflection between second outer wall 32 and partition wall 34. Ramp-like and angled surfaces 130, 134 and 136 facilitate insertion of lock lever 16 into second chamber 34 and relative deflection outwardly between partition wall 34 and second outer wall 32.

With latch handle 14 and lock lever 16 secured within housing 12, spring 22 is inserted into first chamber 42 from inner end 68 thereof. Spring 22 includes legs 140 and 142 secured against housing 12 and latch handle 14 so as to bias latch handle 14 toward a position in which the vehicle door latch mechanism (not shown) is secured.

Latch handle 14 and lock lever 16 can pivot about the respective connections thereof to housing 12. Substantially smooth interfaces are provided between apertures 46, 48, 88 and 114 and projections 50, 90 and 116 received therein. Apertures 46, 48, 88 and 114 are enclosed at perimeters thereof by first outer wall 30, second outer wall 32 latch handle 14 and lock lever 16, respectively, to fully encircle the projections held therein. Smooth, reliable operation of latch handle 14 and lock lever 16 is promoted.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A door handle assembly comprising:

a housing including a first outer wall defining a first aperture therein, a second outer wall defining a second aperture therein, and a partition wall between said first and second outer walls, said partition wall defining a projection extending toward said second outer wall, wherein said first aperture, said second aperture and said projection are in substantial axial alignment;

a latch handle defining a latch handle projection received in one of said apertures of said first and second outer walls and a latch handle aperture receiving said partitioned wall projection therein, said latch handle having an extension thereof spanning said partition wall;

a lock lever defining a lock lever projection received in the other of said apertures in said outer walls, and defining a lock lever aperture receiving said projection of said partition wall; and wherein said lock lever is disposed in a chamber defined between said partition wall and said second outer wall, said latch handle has a panel extending into said chamber, and said lock lever is disposed between said panel and said second outer wall.

2. The door handle assembly of claim 1, said lock lever defining a ramp-like surface adjacent said lock lever aperture, said ramp-like surface angling outwardly from an inner portion of said lock lever toward said lock lever aperture.

3. The door handle assembly of claim 1, said second outer wall defining a ramp-like surface angling inwardly in said chamber from an outer edge of said second wall to said aperture defined in said second outer wall.

4. The door handle assembly of claim 1, said projection of said lock lever having an inner portion thereof that angles outwardly in said chamber in a direction toward said second outer wall.

5. The door handle assembly of claim 4, said second outer wall defining a ramp-like angling inwardly in said chamber from an outer edge of said second wall to said aperture defined in said second outer wall.

6. The door handle assembly of claim 4, said lock lever defining a rump-like surface adjacent said lock lever aperture, said ramp-like surface angling outwardly from an inner portion of said lock lever toward said lock lever aperture.

7. The door handle assembly of claim 6, said second outer wall defining a ramp-like surface angling inwardly in said chamber from an outer edge of said second wall to said aperture defined in said second outer wall.

8. A vehicle door handle assembly, comprising:

a housing having first and second outer walls and a partition wall defining a first chamber between said first outer wall and said partition wall and a second chamber between said second outer wall and said partition wall, said first outer wall defining a first outer wall aperture, said second outer wall defining a second outer wall aperture and a said partition wall defining a projection extending into said second chamber, said first outer wall aperture, said second outer wall aperture and said projection of said partition wall being substantially coaxial;

a latch handle configured to be received substantially in said first chamber and having an extension thereof spanning said partition wall and a panel from said extension disposed in said second chamber, said latch handle defining a latch handle projection received in said first outer wall aperture and a latch handle aperture in said panel receiving said partition wall projection; and a lock lever configured to be received in said second chamber, said lock lever being disposed between said partition wall and said second outer wall, said lock lever defining a lock lever aperture for receiving said partition wall projection and a lock lever projection received in said second outer wall aperture, such that said lock lever is further disposed between said panel and said second wall.

9. The door handle assembly of claim 8, including a spring biasing said latch handle.

10. The door handle assembly of claim 8, including a resilient bumper in said first chamber for engaging said latch handle during operation thereof.

11. The door handle assembly of claim 8, including a latch cable extending into said first chamber and connected to said latch handle.

12. The door handle assembly of claim 8, including a lock cable extending into said second chamber and connected to said lock lever.

13. The door handle assembly of claim 8, said lock lever defining a ramp-like surface adjacent said lock lever aperture, said ramp-like surface angling outwardly from an inner portion of said lock lever toward said lock lever aperture.

14. The door handle assembly of claim 8, said second outer wall defining a ramp-like surface angling inwardly in said second chamber from an outer edge of said second wall to said second outer wall aperture.

15. The door handle assembly of claim 8, said lock lever projection having an inner portion Thereof that angles outwardly in said chamber in a direction toward said second outer wall.

16. The door handle assembly of claim 8, said apertures have enclosed sides.

17. A method of assembling a vehicle door handle assembly, comprising:

providing a housing defining first and second outer walls and a partition wall therebetween;

providing a projection on the partition wall directed toward the second outer wall;

providing a latch handle having a first side configured to face towards the first wall, a second side configured to face towards the second wall and a latch handle aperture in the second side for receiving the projection of the partition wall;

providing a lock lover having a first side configured to face towards the first wall, a second side configured to face towards the second wall and a lock lever aperture in the first side for receiving the projection of the partition wall;

providing an aperture in one of the first outer wall of the housing and the first side of the latch handle, and a boss in the other of the first outs wall of the housing and the first side of the latch handle;

providing a second aperture in one of the second outer wall of the housing and the second side of the lock lever, and a boss in the other of the second outer wall of the housing and the second side of the lock lever;

the foregoing arrangement being such that the housing only includes three mounting members for receiving both the latch handle and the lock lever, the three mounting members being the projection on the partition wall and a combination of holes and/or bosses on the first and second outer walls, the mounting members being arranged in such a manner so as to be in coaxial alignment;

aligning the first side of the latch handle with the first outer wall of the housing, and further aligning the second side of the latch handle with the partition wall;

causing relative lateral movement between the latch handle and the housing by moving the latch handle into engagement with the housing, such that the latch handle aperture is received by the projection on the partition wall, and the aperture in one of the first outer wall of the housing and the first side of the latch handle is received by the boss in the other of the first outer wall of the housing and the first side of the latch handle;

aligning the second aide of the lock lever with the second outer wall of the housing, and further aligning the first side of the lock lever with the partition wall; and urging the lock lever between the partition wall and the second outer wall while deflecting the partition wall and the second outer wall outwardly relative to each other, such that the lock lever aperture is received by the projection on the partition wall and the second aperture in one of the second outer wall of the housing and the second side of the lock lever is received by the boss in the other of the second outer wall of the housing and the second side of the lock lever.

* * * * *